United States Patent [19]

Huber, Jr. et al.

[11] Patent Number: 4,526,749

[45] Date of Patent: Jul. 2, 1985

[54] TANTALUM-COLUMBIUM-MOLYBDENUM-TUNGSTEN ALLOY

[75] Inventors: Louis E. Huber, Jr., Allentown; Harry D. Schwartz, Reiffton, both of Pa.

[73] Assignee: Cabot Corporation, Kokomo, Ind.

[21] Appl. No.: 627,155

[22] Filed: Jul. 2, 1984

[51] Int. Cl.[3] ..... C22C 27/02

[52] U.S. Cl. ..... 420/427; 148/422

[58] Field of Search ..... 420/427; 148/422

[56] References Cited

FOREIGN PATENT DOCUMENTS

| | | | |
|---|---|---|---|
| 1123836 | 2/1962 | Fed. Rep. of Germany | 420/427 |
| 39-24207 | 10/1964 | Japan | 420/427 |
| 0933712 | 8/1963 | United Kingdom | 420/427 |

*Primary Examiner*—L. Dewayne Rutledge
*Assistant Examiner*—Debbie Yee
*Attorney, Agent, or Firm*—J. Schuman; J. J. Phillips

[57] ABSTRACT

Disclosed is a novel refractory metal alloy that retains the essential characteristics of pure tantalum and, additionally, has improved engineering characteristics and may be produced at a lower cost than pure tantalum. The alloy nominally contains, by weight, about 58% tantalum, about 2.0% molybdenum, about 2.5% tungsten and about 37.5% columbium.

3 Claims, No Drawings

TANTALUM-COLUMBIUM-MOLYBDENUM-TUNGSTEN ALLOY

This invention relates to a tantalum base alloy characterized by having an optimum combination of properties, and, more particularly, to an alloy containing columbium, molybdenum, tungsten and the balance tantalum.

PRIOR ART

Many columbium and tantalum alloys are known in the prior art. Table 1 presents the composition ranges of a group of such alloys disclosed in U.S. Patents.

U.S. Pat. No. 3,186,837 relates to a columbium-tantalum base alloy. The alloy is disclosed as a columbium base alloy requiring effective nickel and titanium contents for corrosion resistance and two-phase alloy structure, respectively. U.S. Pat. No. 3,188,205 discloses a columbium base alloy containing effective ranges of titanium, zirconium, tungsten and molybdenum and a maximum of 35% tantalum. U.S. Pat. No. 3,188,206 is a related patent disclosing a somewhat similar alloy (tungsten and molybdenum free) with a maximum of 40% tantalum.

U.S. Pat. No. 3,592,639 relates to a ternany TA-W-MO alloy. Molybdenum is limited to 0.5% maximum to promote smaller grain size in the alloy.

U.S. Pat. No. 3,346,379 relates to a predominately columbium alloy (over 55%) containing requirements from the group tungsten, molybdenum, iron, chromium and zirconium. Only 5% maximum tantalum is tolerated as an impurity.

U.S. Pat. No. 1,588,518 mentions practically the entire scope of nickel and cobalt base superalloys and refractory metals: 25–99% Ta+Cb, 1–75% Ni+Co, 5–30% Cr+W+Mo. The typical example alloy in the specification contains 75% nickel, 25% tantalum and 5 to 30% chromium.

PRIOR ART ALLOYS

The patents described in Table 1 disclose tantalum and columbium alloys especially designed to enhance certain specific characteristics for various uses as required.

Commercially there are limited refractory metal alloys available. One is a binary alloy 40% columbium and 60% tantalum which is designed to replace pure tantalum in some applications. Another commercial alloy contains about 2.5% tungsten balance tantalum. While still another similar commercial binary alloy contains 10% tungsten.

These alloys are meeting a limited degree of acceptance in the art. The alloys, in general, may be substituted for pure tantalum. In many applications, these alloys adequately meet the specifications for pure tantalum. The alloys lack sufficient improved characteristics to be considered as a novel material with a higher degree of engineering properties.

OBJECTS OF THIS INVENTION

It is the principal object of this invention to provide a novel alloy with an outstanding combination of engineering properties.

It is another object of this invention to provide a superior alloy at lower costs.

SUMMARY OF THIS INVENTION

Table 2 discloses the composition ranges of the alloy of this invention. The alloy is essentially a quaternary alloy containing, as major elements, tantalum and columbium and, as minor elements, tungsten and molybdenum. The alloy is predominately tantalum base (56% minimum) to retain the basic tantalum characteristics plus additional improvements provided by tungsten and molybdenum. The balance of the alloy is columbium plus normal impurities found in alloys of this class. Most of the impurities may be adventitious residuals from the alloying elements or processing steps. Some of the impurities may be beneficial, some innocuous, and some harmful as known in the art of refractory metals.

EXPERIMENTAL RESULTS

As a means to obtain the objects mentioned above, three alloy compositions were chosen for study.

The alloys were prepared in powder form then pressed into bar as an electron beam feed stock. The bar was then triple electron beam purified, warm (less than 500° F.) hammer forged to slab, annealed, then rolled to plate and annealed, then rolled to 0.030" sheet followed by a final anneal at 1250° C. for 2 hours. The analyses in weight percent of the alloys were essentially as follows:

| | | | | |
|---|---|---|---|---|
| Alloy 41 | 58 Ta | 37.5 Cb | 2.5 W | 2.0 Mo |
| Alloy B | 58 Ta | 40 Cb | 0 W | 2.0 Mo |
| Alloy C | 60 Ta | 37.5 Cb | 2.5 W | 0 Mo |

Table 3 presents results of mechanical tests. The tests were conducted at room temperature. Each of the alloys was 100% recrystallized and had an average grain size of ASTM 8.5 to 9.0.

These data show that molybdenum and tungsten are not interchangeable. Both elements must be present within the ranges disclosed in Table 2. To assure optimum benefits of this invention, molybdenum and tungsten should be present in about equal amounts, but may be present within the ratio Mo:W=0.5 to 2.

In another series of tests, alloys listed in Table 4 were prepared by the same processes mentioned above. Further mechanical test results are presented in Table 5. These data clearly show the superiority of the alloy of this invention (Alloy 41) over all other experimental alloys except Alloy 10 which is commercially pure tantalum plus 10% tungsten. Alloy 40 is perhaps the best known alloy now used in the art. Alloy 41 clearly exceeds alloy 40 in yield strength.

Table 6 contains results of chemical tests: corrosion resistance and hydrogen absorption data. Listed in Table 6 are the corrosive media and the test temperature. All examples were exposed in the media for a 96-hour period. The corrosion resistance is expressed as corrosion rate in mils per year, Mpy.

The corrosion tests clearly show the alloy of this invention to have essentially the same corrosion rates as pure tantalum and Alloy 40.

After the corrosion tests, the specimens were given hydrogen absorption tests. Results of the tests are reported in parts per million, PPM, of hydrogen absorption. These data clearly show the alloy of this invention is essentially similar to pure tantalum; however, Alloy 41 is far superior over commercial Alloy 40. This constitutes a major improvement in the art.

TABLE 1

| ELEMENTS | U.S. Pat. No. 3,186,837 | U.S. Pat. No. 3,188,205 | U.S. Pat. No. 3,188,206 | U.S. Pat. No. 3,592,639 | U.S. Pat. No. 3,346,379 | U.S. Pat. No. 1,588,515 |
|---|---|---|---|---|---|---|
| | Prior Art Alloys Composition, in weight percent, w/o | | | | | |
| Ta | 20–50 | 35 max | 40 max | Bal | 5 max | 25 min |
| Ti | 2–15 | .2–2.0 | .2–2.0 | — | — | — |
| Ni | 2–15 | — | — | — | — | — |
| W | 0–7.5 | 5–16 | — | 1.5–3.5 | 1–30 | — |
| Mo | 0–7.5 | 3–10 | — | — | 1–20 | — |
| W + Mo | 0–15 | 5–16 | — | — | 2–50 | 5–30 |
| Sn | 0–4 | — | — | — | — | — |
| Zr | — | .3–5.0 | .3–5.0 | — | — | — |
| V | 0–10 | — | — | — | — | — |
| Fe, Cr | | | | | | |
| W, Zr | — | — | — | — | 1–30 | — |
| Cr | — | — | — | — | — | 5–30 |
| Ni + Co | — | — | — | — | — | 1–75 |
| Ta + Cb | — | — | — | — | — | 25–99 |
| Cb | Bal | Bal | Bal | .5 max | 55 min | 25 min |

TABLE 2

| ELEMENT | BROAD RANGE | WORKING RANGE | AIM |
|---|---|---|---|
| | Alloy of this Invention Composition, in weight percent | | |
| Ta | 56–68 | 56–66 | 58 |
| Mo | 1.5–5.0 | 1.5–3.0 | 2.0 |
| W | 2–5.0 | 2–3 | 2.5 |
| Cb* | Bal | Bal | Bal |

*Columbium plus impurities

TABLE 3

| | | Ultimate Tensile Strength (psi) | Yield Strength (psi) | Elongation 2 in. gage (%) |
|---|---|---|---|---|
| | Mechanical Testing - Experimental Alloys .030" thick annealed sheet | | | |
| | Transverse | 73,200 | 63,500 | 23 |
| | to the | 73,400 | 63,200 | 26 |
| | Direction of Rolling | | | |
| Alloy 41 | Parallel | 69,200 | 53,100 | 24 |
| | to the | 69,500 | 53,900 | 23 |
| | Direction of Rolling | | | |
| | Transverse | 60,400 | 48,800 | 27 |
| | | 59,400 | 49,100 | 27 |
| Alloy B | Parallel | 60,500 | 48,500 | 24 |
| | | 60,600 | 47,800 | 29 |
| | Transverse | 62,000 | 52,200 | 25 |
| | | 60,900 | 51,500 | 27 |
| Alloy C | Parallel | 62,400 | 50,100 | 26 |
| | | 61,800 | 49,400 | 25 |

TABLE 4

| Metal or Alloy No. | Ta | Cb | W | Mo |
|---|---|---|---|---|
| | Experimental Alloys in Test Series in percent by weight | | | |
| Tantalum | cp* | — | — | — |
| Columbium | — | cp* | — | — |
| 6 | Bal | — | 2.5 | — |
| 10 | Bal | — | 10 | — |
| 40 | Bal | 40 | — | — |
| 34-6 | Bal | 34 | 6 | — |
| 41 Alloy of this invention | Bal | 37.5 | 2.5 | 2.0 |

cp* Commercially pure metal used in this art

TABLE 5

| Temperature °C. | °F. | Ta | Cb | 6 | 10 | 40 | 34.6 | 41 |
|---|---|---|---|---|---|---|---|---|
| | | Mechanical Tests Yield Strength, KSI | | | | | | |
| | | | | Alloy No. | | | | |
| RT | RT | 23.5 | 24.3 | 33.7 | 71.3 | 28.2 | 55.4 | 63.3 |
| 100 | 212 | 14.0 | 23.1 | 30.2 | 62.4 | 24.7 | 50.3 | 56.8 |
| 200 | 392 | 12.0 | 22.1 | 28.7 | 56.4 | 23.2 | — | 51.5 |
| 300 | 572 | 13.1 | 21.6 | 26.3 | 53.5 | 23.4 | 39.3 | 47.4 |
| 400 | 752 | 10.4 | 21.6 | 24.0 | 51.1 | 24.0 | — | 46.3 |
| 500 | 932 | 8.9 | 20.0 | 21.7 | 50.8 | 24.8 | 35.0 | 44.3 |

TABLE 6

| Media and temperature, after 96-hour test | Tantalum Corrosion Rate Mpy* | Tantalum HA** PPM | Alloy 40 Corrosion Rate Mpy* | Alloy 40 HA** PPM | Alloy 41 Corrosion Rate Mpy* | Alloy 41 HA** PPM |
|---|---|---|---|---|---|---|
| | Chemical Tests Corrosion Resistance and Hydrogen Absorption | | | | | |
| 30% HCL AT 130° C. | NIL | <5 | 4 | 20–100 | 4 | 5 |
| 30% HCL AT 150° C. | <1 | — | 15 | 50–700 | 17 | 5 |
| 20% HCL + 50 PPMFECL$_3$ At Boil. (approx. 110° C.) | 0.1 | 25 | 0.1 | 15 | 0.1 | <5 |
| 60% $H_2SO_4$ At Boil. (143° C.) | 0.2 | <5 | 2 | 5 | 1 | <5 |
| 70% $H_2SO_4$ At Boil. (170° C.) | 0.5 | <5 | 8 | 15 | 5 | <5 |
| 77% $H_2SO_4$ At Boil. (200° C.) | 1.8 | <5 | 38 | 35 | — | — |
| 70% $HNO_3$ At Boil. (120° C.) | NIL | <5 | NIL | <5 | NIL | <5 |

*Corrosion rate in mils per year, Mpy
**Hydrogen Absorption (HA), in parts per million, PPM.

What is claimed is:

1. A refractory metal alloy consisting essentially of, in weight percent, tantalum 56 to 68, molybdenum 1.5 to 5.0, tungsten 2.0 to 5.0 and the balance columbium plus normal impurities wherein the ratio Mo:W is within the range 0.5 to 2 to provide an outstanding combination of engineering properties.

2. The alloy of claim 1 wherein tantalum is 56 to 66, molybdenum 1.5 to 3.0 and tungsten 2.0 to 3.0.

3. The alloy of claim 1 wherein tantalum is about 58, molybdenum is about 2.0, tungsten is about 2.5 and the columbium is about 37.5.

* * * * *